US005163257A

United States Patent [19]

Crowell

[11] Patent Number: 5,163,257

[45] Date of Patent: Nov. 17, 1992

[54] GLAZING BAR SYSTEM

[76] Inventor: James Crowell, P.O. Box 1956, Lake Oswego, Oreg. 97035

[21] Appl. No.: 643,049

[22] Filed: Jan. 18, 1991

[51] Int. Cl.[5] ..... E04C 1/34

[52] U.S. Cl. ..... 52/200; 52/397; 52/464; 52/584

[58] Field of Search ..... 52/459–472, 52/395–403, 584, 280, 282, 772, 732, 222, 200

[56] References Cited

U.S. PATENT DOCUMENTS

| | | | |
|---|---|---|---|
| 723,953 | 3/1903 | Waldmire | 52/395 |
| 974,310 | 11/1910 | Thompson | 52/467 |
| 1,156,335 | 10/1915 | Waugh | 52/467 |
| 1,417,102 | 5/1922 | Nyman et al. | 52/464 |
| 1,548,083 | 8/1925 | Young et al. | 52/464 |
| 1,812,009 | 6/1931 | Lenke | 52/395 |
| 1,872,868 | 8/1932 | Abronski | 52/467 |
| 2,157,189 | 5/1939 | Schlosinger | 52/395 |
| 2,263,511 | 11/1941 | Lindsay | 52/222 |
| 2,363,164 | 11/1944 | Waller | 52/464 |
| 2,526,727 | 10/1950 | Bull | 52/461 |
| 3,423,892 | 1/1969 | Rimington | 52/772 |
| 3,423,896 | 1/1969 | Widerby | 52/584 |
| 3,724,886 | 4/1973 | Widerby | 52/584 |
| 4,587,776 | 5/1986 | Leurent | 52/463 |
| 4,658,559 | 4/1987 | Doherty | 52/732 |
| 4,891,920 | 1/1990 | Pingston | 52/584 |

*Primary Examiner*—James L. Ridgill, Jr.

[57] ABSTRACT

A system for the assembly of wall or roof panel structures which may include light-transmitting plastic panel portions. The assembly comprises two solid material splines attached to opposite faces of a panel along its margin. The resulting combination of panel and splines forms a capital I shape in cross-section, and is held in place as a sandwich system, between support members having flanges extending toward, and almost touching the panel. A preferred panel may have two thin sheets including parallel major surfaces, the sheets being interconnected and spaced apart by a plurality of web-like ribs. The support members retain the panels and provide space for attachment to other portions of a building's structural frame, or to a cable structural system.

25 Claims, 17 Drawing Sheets

GLAZING BAR SYSTEM

BACKGROUND AND SUMMARY OF THE INVENTION

The present invention relates to a system for the assembly of structural panel systems, and particularly to the assembly of light-transmitting sections such as windows, skylights and roof glazing of buildings.

While the traditional glazing bar assembly system for light transmitting portions of buildings works fairly well for supporting glass, its disadvantages are numerous and weighty when used with transparent structural panels of other materials. For example, such structural panels may be formed as thin parallel sheets of plastic interconnected by parallel ribs which give stiffness and thermal insulation qualities to such panels. Such plastic panels are more flexible and lighter in weight than glass, but also have much larger thermal coefficients of expansion than glass. These characteristics help to make previous structures, incorporating such plastic panels held between rubber or rubber-like gaskets, supported in metal frames liable to leakage, to gasket pull-out, and to panel blow-out due to air pressure differences. Excessive noise is caused by movement of such plastic panels against gasket material in response to the extreme difference between the thermal coefficients of expansion of the dissimilar materials and because of the grasping action of the conventional gasketing materials on panel surfaces. Standard structural plastic sheet is not recommended to be used beyond a certain length without a mullion because of the possibility of being dislocated by negative air pressure differences from wind passing over the panel.

The traditional assembly system for roof-surface portions, especially light transmitting portions, requires a solid structural frame system for support. Its disadvantages are numerous, especially in the spanning of very long distances, which requires large and very expensive structural systems. This is especially true in curved applications where the structural system must be preshaped in a factory and shipped in curved shape to the job site.

It is one of the objects of the present invention to overcome these and other disadvantages and drawbacks of the prior art glazing bar systems for incorporation of plastic panels in structures and to provide a system which is simple, reliable, and relatively easily used in the field.

It is another object of the invention to provide a structural system by which the plastic panel units according to the invention can be custom cut at a construction site and then joined edge-to-edge to form a "skin" of a desired width and length.

It is another of the objects of the present invention to provide a weathertight structural system which is extremely light in weight, amply strong in tension and relatively inexpensive.

It is another of the objects of the present invention to provide a structural system that may be shipped flat to the job site and assume the desired curved shape during assembly.

Another object of the present invention is to provide a structure utilizing plastic sheets or panels and of such a design that it can extend between relatively widely-spaced supporting structures.

The present invention achieves these objects by providing a glazing bar system incorporating a novel structural fastening arrangement for holding plastic panels in place. The system according to the present invention is a clamping bar glazing system comprising panel units having at least one retaining member such as a retainer strip of plastic material located along one margin of a face of a panel unit, and having two glazing bars, at least one including a flange to engage the retainer strip, with one glazing bar on each side of the panel, with the flange engaging the retainer strip to hold the panel between the glazing bars.

In a preferred embodiment of the invention a retainer strip of plastic material is provided, protruding outward along the margin of a panel on each of the opposite sides. The glazing bars are extrusions which have flanges extending toward the sheet-like panel. When the resulting panel is engaged on both sides by the glazing bars, it is locked into its desired location by the flanges.

It is a feature of the panel unit according to the invention that, using an abrasion-resistant, low-friction surface on the outer side of the projecting retainer strip, it is possible to avoid the noise created by the movement of the panel against a surface of different properties, resulting from differences of expansion and contraction.

It is another feature of the structural arrangement according to the present invention that the retainer strip extending along the margin of the panel is a natural dam against water leakage past the juncture of the panel and the supporting glazing bar combination.

It is a further feature of one embodiment of the invention that it includes a chamber within the glazing bar assembly where cables or other structural members may be located, to support the assembly as a "skin" stretched between retaining walls or other structural supports.

It is a further feature of one embodiment of the invention that the assembly acting as a "skin" can be suspended from a cable web structural system by attaching suitable cables to the glazing bar assemblies.

The present invention also provides structures for use in interconnecting two frame and panel assemblies perpendicular to each other to create a roof and removable wall system.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 1:
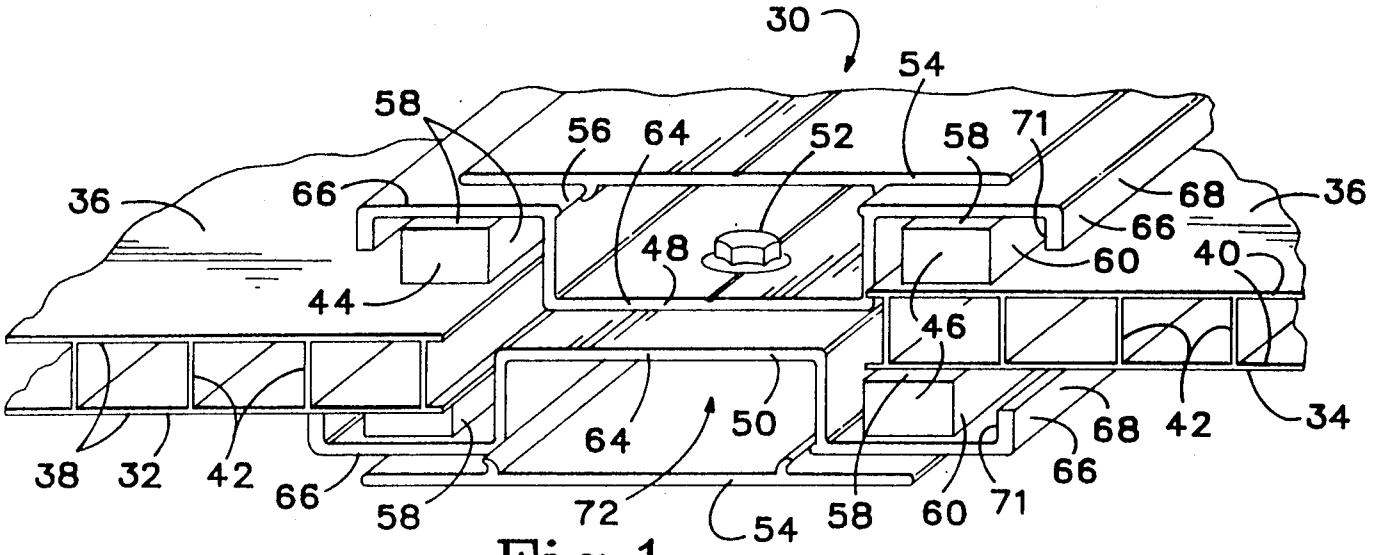
FIG. 1 is an oblique sectional end view of a portion of a panel securing assembly and a pair of interconnected plastic panels, embodying the present invention.
Figure 2:
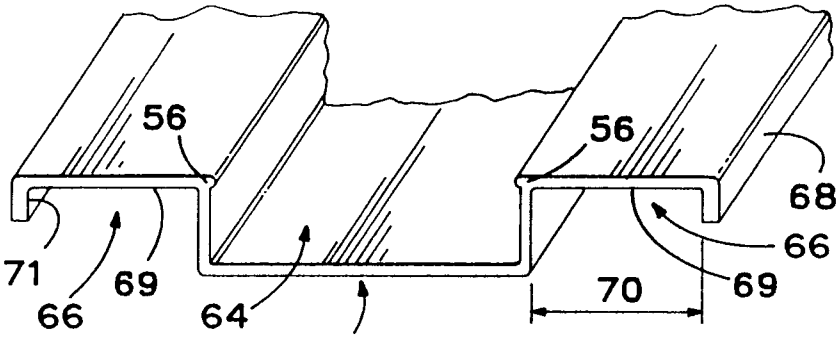
FIG. 2 is an oblique end view of one of the glazing bars forming part of the panel securing assembly shown in FIG. 1.

Referring first to FIGS. 1 and 2 of the drawings, a "single pane" window assembly 30 according to the present invention includes two panels 32, 34 which may be of extruded plastic, such as a polycarbonate or acrylic. Such panels may be solid, but preferably are of hollow structure with a pair of parallel opposite major faces 36 defined by face sheets 38, 40 joined by ribs 42, all of which may be produced in a desired size as an integral extrusion.

The assembly 30 shown in FIG. 1 may be used as a free-standing connection of the two panels 32, 34. Each of the panels 32, 34 has a respective plastic retainer strip member 44, 46 as a retaining member, bonded to a marginal portion of each major face 36 of the panel preferably by a suitable adhesive, tape or welding system. This creates a "T" shape along the entire margin of each panel 32, 34.

The two panels 32, 34 are held together by a sandwich-like securing assembly formed b fastening together two glazing bars 48, 50 by fasteners such as bolts 52, as shown in FIG. 1. The glazing bars may be of extruded aluminum or other material of suitable strength. Cover caps 54 of similar material can be snapped in place to to cover the bolts 52, as shown in FIG. 1. As shown in FIG. 2, each glazing bar 48 or 50 includes projections 56 for engaging the snap-in cover cap 54.

Each retainer member is preferably a solid member preferably of a strong, low-friction and abrasion-resistant material such as an ultra-high molecular weight (UHMW) polyethylene plastic. At least the outer surface 58 of each retaining member 44, 46 should be of abrasion-resistant low-friction material such as UHMW polyethylene or PTFE to allow smooth movement when in contact with a surface of one of the glazing bars. The side surface 60 of the retaining member 44, 46, facing toward the main area of the panel, should be of a material able to take a hard impact without significant deformation. The retaining member 44 is attached to one of the main sheets 38, 40 by an adhesive, tape or welding system such as an adhesive bonding tape to bond the retaining member 44 or 46 permanently to one of the major faces 36 of the panel 32 or 34.

Each glazing bar 48, 50 has a middle portion 64 and a pair of wings 66, all preferably a unitary extrusion. Each wing portion 66 is preferably especially prepared to provide a very smooth planar inner panel-support surfaces 69 between the middle portion 64 and a respective flange 68 extending from each of the wings 66 in a direction perpendicular to the glazing bar defining a panel retaining surface 71. The width 70 of each panel-support surface 69 is sufficient to allow ample room for the movement of the panel retaining member 44 or 46 toward or away from the middle portion 64 during expansion and contraction of the panel 32 or 34.

The middle portion 64 provides a gutter deep enough to allow full clearance for the bolts 52 or other fasteners to be located below the outside edge of the panel, yet not so deep as to touch the middle portion 64 of the opposite glazing bar 50 after assembly. The middle portion 64 also is adequate in depth and width to serve as a receiving channel 72 for receiving portions of structural members of the proper width to provide support for the panel assembly 30 as required.

The combination of the retaining members 44, 46 and the flanges 68 prevents the panels 32, 34 from being blown out of the desired position of engagement in the sandwich assembly, while permitting expansion and contraction and flexing of the panels 32, 34 in amounts greater than would occur in glass panels of similar size. The flanges 68 extend toward the major faces 36 but do not touch, so that the retaining members 44, 46, with their outer surfaces 58 in contact with support surfaces 69, also act as dams to exclude water from passing between the panels 32, 34 and the glazing bars 48, 50.

Figure 3:
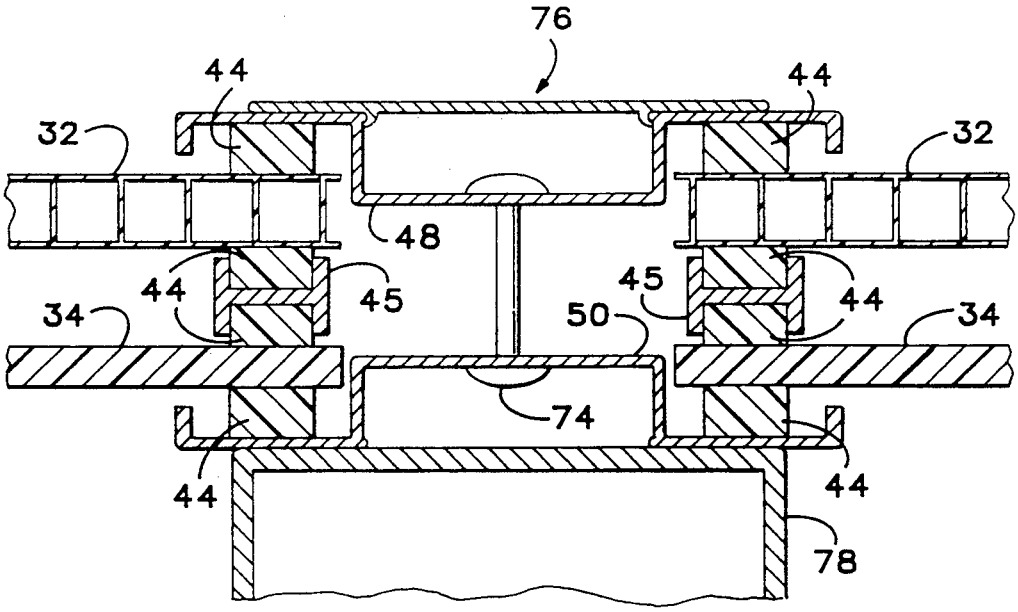
FIG. 3 is a sectional end view of a double-pane window assembly embodying the present invention attached to a structural larger in width than the assembly.
Figure 4:
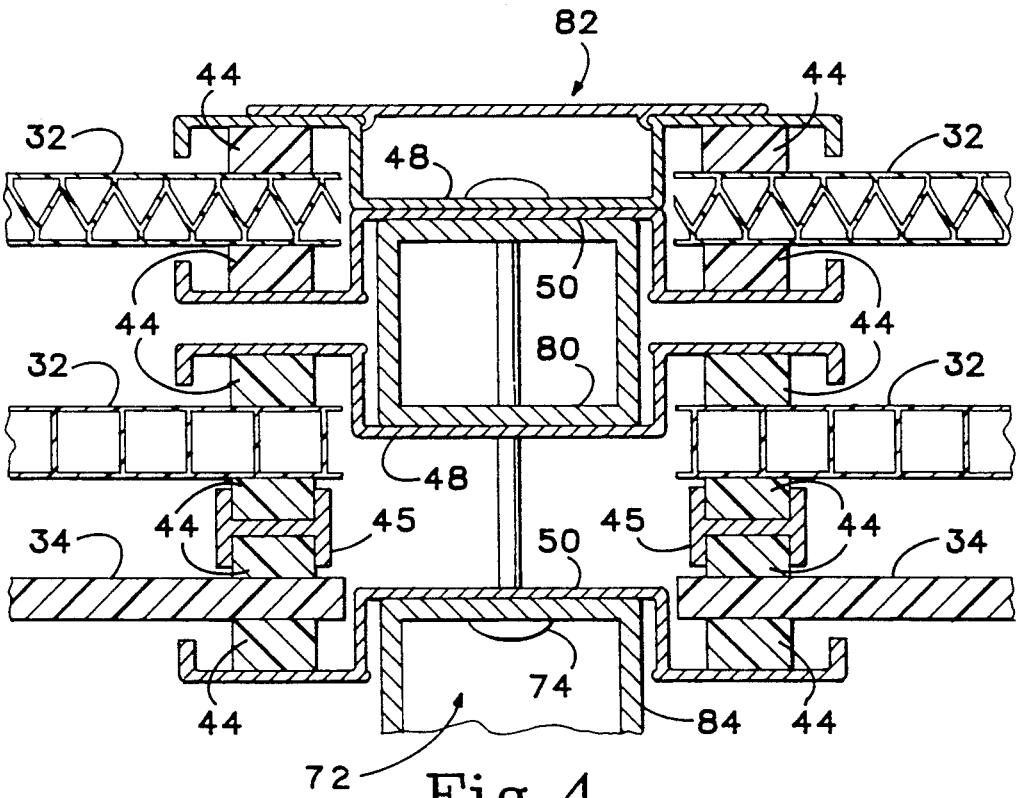
FIG. 4 is a sectional end view of a multiple-pane window assembly according to the invention attached to a structural of a width which fits in a channel defined by the assembly.

While the above-described "single-pane" embodiment of the invention gives satisfactory service under most environmental conditions, maintaining particularly high temperature differentials with a minimum of losses might require still better thermal insulation. Such superior insulation can be provided by a "multi-pane" window arrangement as shown in FIGS. 3 and 4, using several panels 32, 34 and glazing bars 48, 50 according to the invention, held together by long fasteners such as bolts 74 of appropriate length, spaced apart along the length of such pairs of glazing bars. This embodiment is shown in FIG. 3 as a "double pane" or in FIG. 4 as a "multi-pane" assembly.

In FIG. 3 an assembly 76 embodying the invention includes two pairs of glazing bars 48, 50 to form a "double pane" window and is attached to a structural member 78 of greater width than the panel securing assembly. A spacer 45 of a strong, low-friction and abrasion-resistant material with an "H"-shaped section may serve as an interlock as well as a spacer between the pairs of retainer members 44. The fasteners, bolts 74, are used to create a solid sandwich of the assembly. Any of various conventional fastening methods, including adhesives, may be used to attach the assembly 76 to the structural member 78.

In FIG. 4 a "multi-pane" window assembly 82 embodying the invention is shown attached to a structural member 84 of the proper width to fit in the receiver chamber 72 defined by the middle portion of the outer one of the glazing bars 48. Different types of panels 32, 34 may be used, each being provided with retainer members 44 as described above with respect to the assembly 30 (FIG. 1). A spacer block 80 may be used as a stiffener as well as a spacer between the pairs of glazing bars 48.

Figure 5:
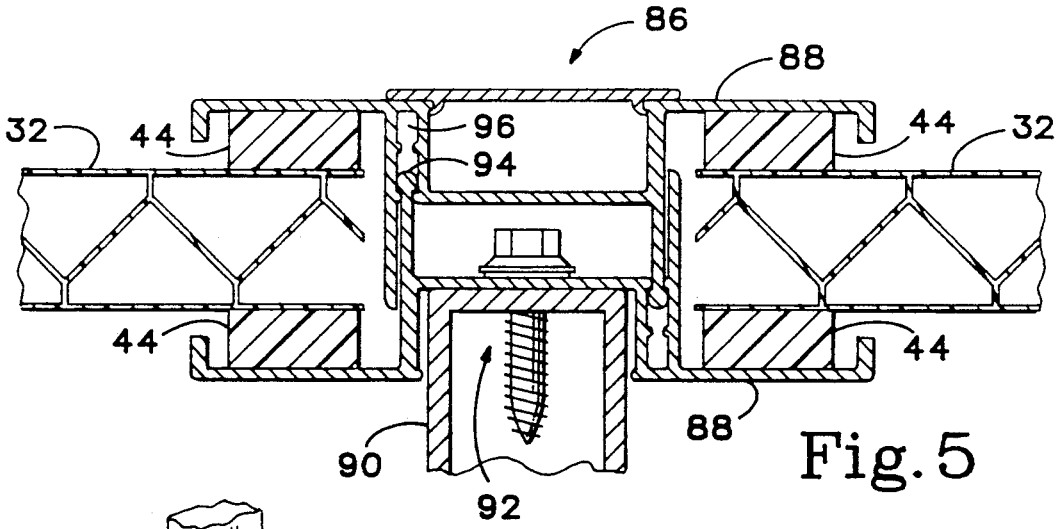
FIG. 5 is a sectional end view of a panel assembly including a mating pair of glazing bars, attached to a structural member of a width which fits in a channel defined by one of the glazing bars.

In FIG. 5 an assembly 86 of two interlocking glazing bars 88 is shown, together with a structural member 90 of the proper width to insert into the receiving chamber 92 of the glazing bar 88. In a preferred embodiment each of the interconnecting glazing bars 88 has a male portion 94 and a correspondingly located female portion 96 offset so that the bars can be mated with each other to provide aligned opposed channels to receive the respective retaining members of panels 32. The projecting male portion 94 has an arrow-like shape seen in section view and is on a shaft of proper length to penetrate to the proper depth and snap into the female portion 96 to interconnect the glazing bars 88 with the proper spacing as required by the thickness of the panels 32. Glazing bars of this type are joined by simply pushing the male and female portions into engagement with their respectively opposite members in an adjacent glazing bar 88, so the pairs of glazing bars 88 retain the panels 32 in the same way as do the glazing bars 48, 50.

Figure 6:
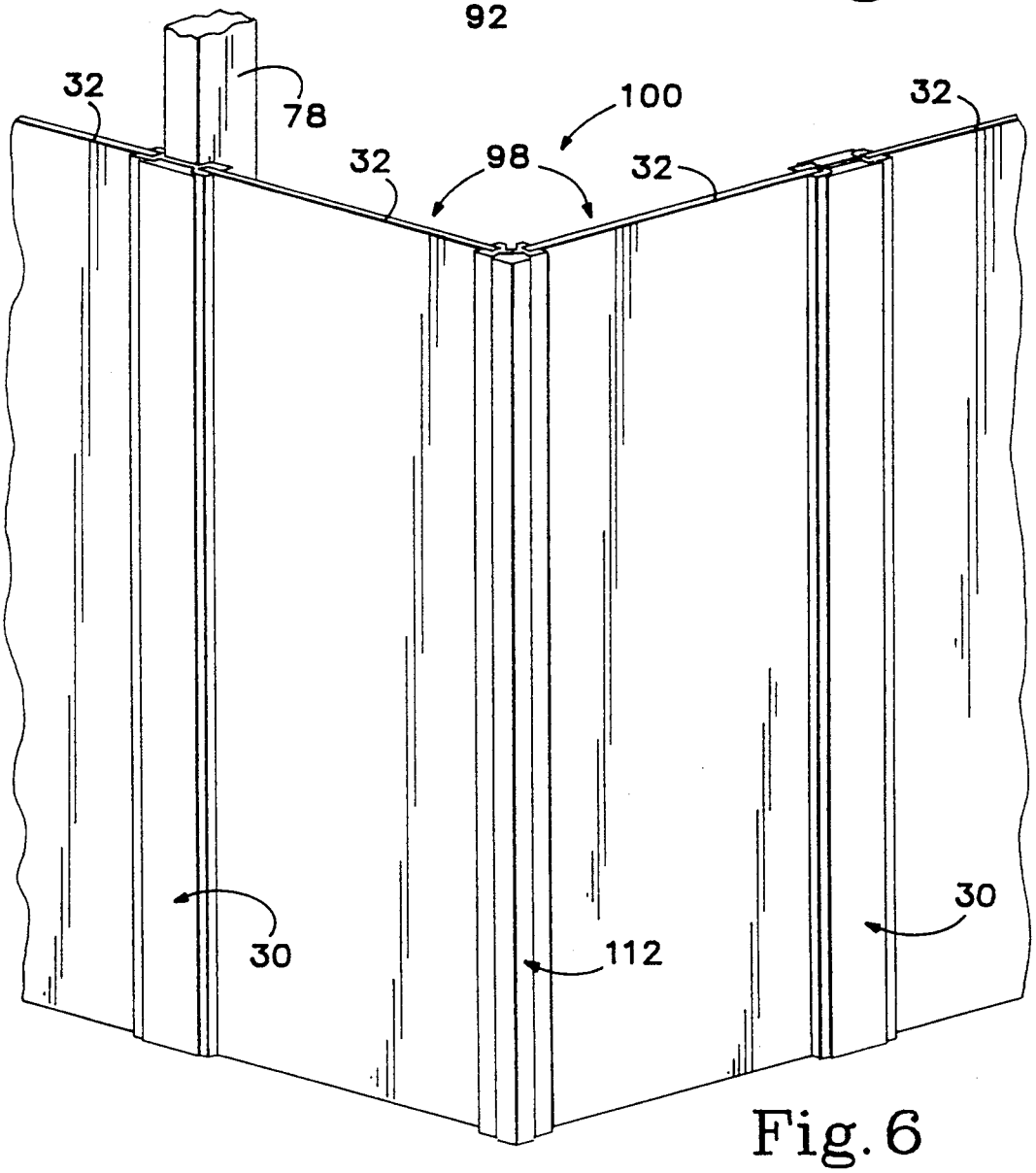
FIG. 6 is an isometric view of a portion of a structure including several panels interconnected according to the present invention.
Figure 11:
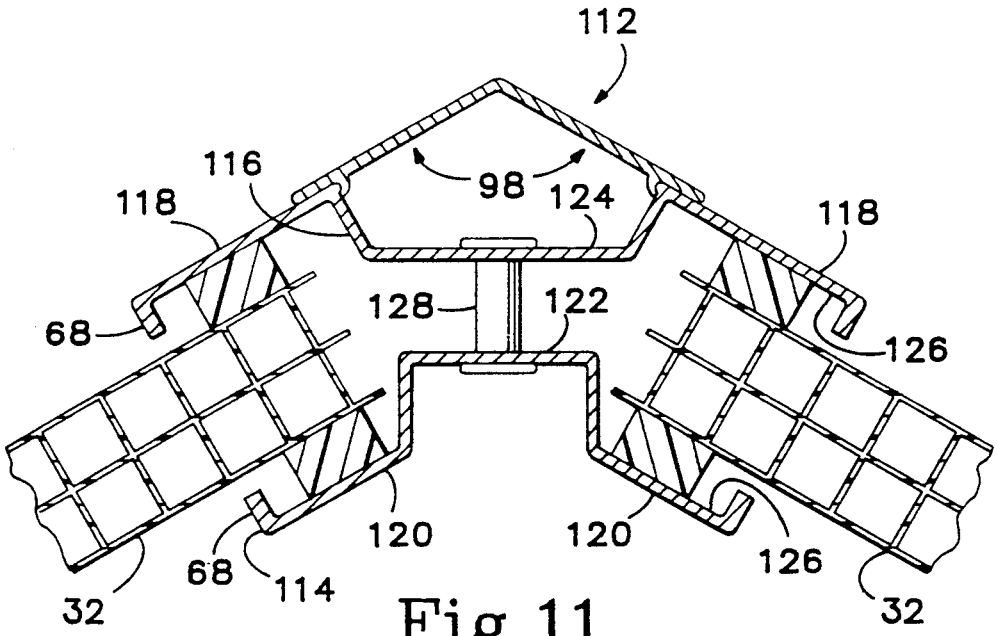
FIG. 11 is a sectional end view of an assembly according to the invention including adjacent panels interconnect in a non-parallel configuration.

Although in the above-described embodiments of the panel assembly of the invention, the angle between the major surfaces is 180°, or parallel, with the single panels comprising a window surface thus lying in a common plane, in other embodiments an angle 98 will be other than 180° as shown in FIGS. 6 and 11. For example, FIG. 6 shows a wall 100 including four panels 32 interconnected by using both free-standing panel-securing assemblies 30 and the structurally supported panel securing and holding assemblies 30. Also shown is a similar assembly joining adjacent panels 32 in other than a parallel plane. Such assemblies of panels as shown in FIG. 11 may be used to form polygons or parts thereof. Such polygons might even be made to approximate circles or circular arcs, if the width of each separate panel 32 sufficiently small relative to the radius of such a circle or arc.

Figure 7:
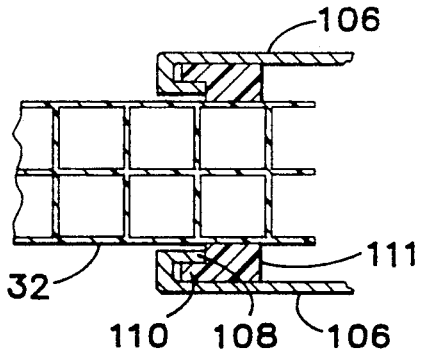
FIG. 7 is a sectional end view of a portion of an assembly similar to that shown in FIG. 1, with retaining strips and glazing bar flanges configured to interlock with each other.

The retaining members of a panel 32 could also be of shapes other than the simple rectangular section of retaining members 44 shown in FIG. 1, if desired for reasons such as better weather resistance. For example, in FIG. 7 a pair of glazing bars 106 have flanges 108 oriented parallel to the panel 32, to interlock with a flange extension 110 of the retainer strip 111 which is also parallel to the panel.

Figure 8:
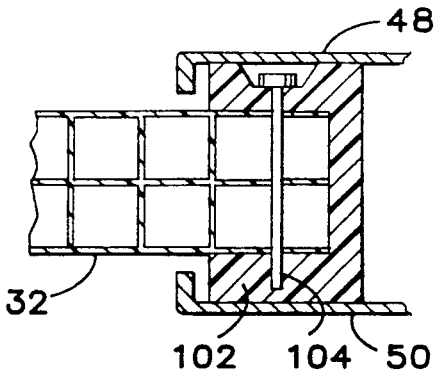
FIG. 8 is a sectional end view of a portion of an assembly similar to that shown in FIG. 1, including a retaining strip member extending around a margin of a panel.

As shown in FIG. 8, instead of two separate retainer strip members 44 as shown in FIG. 1, a unitary retainer 102 is provided in a C-section shape which extends around the margin of the panel 32. Attachment to the panel 32 is enhanced by the use of a recessed fastener pin 104 extending through the retainer 102 and the panel 32.

Figure 9A:
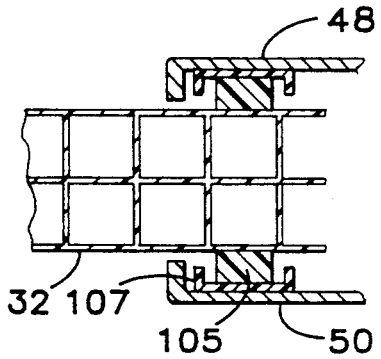
FIG. 9*a* is a sectional end view of a portion of an assembly similar to that shown in FIG. 1 with a two-part retaining strip system shown in FIG. 9*a*.
Figure 9B:
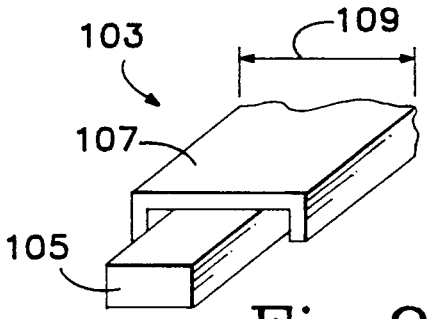
FIG. 9*b* is an isometric end view of the two-part retaining strip system shown in FIG. 9*a*.
Figure 10A:
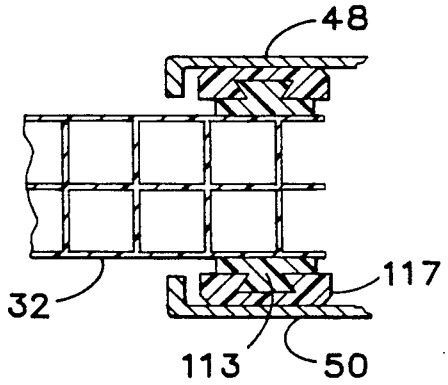
FIG. 10*a* is a sectional end view of a portion of an assembly similar to that shown in FIG. 1 with an interlocking two-part retaining strip system.
Figure 10B:
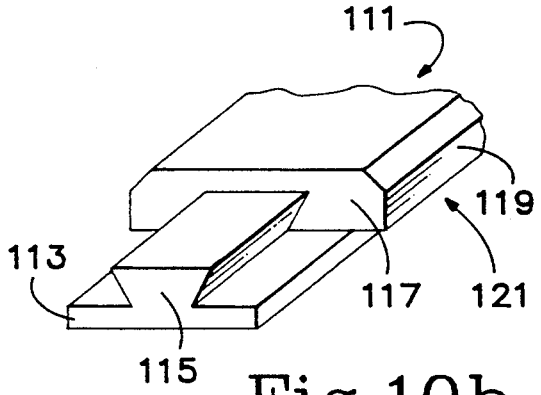
FIG. 10*b* is an isometric end view of the interlocking two-part retaining strip system shown in FIG. 10*a*.

The retaining member 44 could also be in more than one part. FIGS. 9*a*, 9*b*, 10*a* and 10*b* show examples of two-part retaining members. FIG. 9*a* shows a retainer strip assembly 103 in which the solid member portion 105 is bonded to panel 32 and a non-abrasive member 107 defines a channel whose width 109 is wider than the width of portion 105. This allows more ease of movement in both longitudinal and lateral directions. Since there is now a free moving non-abrasive unit 107 between the glazing bar 48 and the panel 32, this reduces the potential for noise. FIG. 9*b* shows the assembly 103 at an enlarged scale. FIGS. 10*a* and 10*b* show a retainer strip assembly 111 which is an interlocking version of the retainer strip 103 shown in FIGS. 9*a* and 9*b*. The solid member 113 is wide at the base for bonding to panel 32. It has the male dovetail interlock 115 for height in acting as a dam to resist rain and runoff. The non-abrasive member 117 is wider 121 than the solid member 113 since it is important non-abrasive surfaces 119 be in contact with the glazing bar 48.

FIG. 11 shows a panel-securing and interconnecting assembly 112 used as a free-standing connection of two non-parallel panels. The glazing bars 114 and 116 have respective wing portions 118, 120 oriented at the appropriate angles to their middle portions 122, 124 to align the panel supporting surfaces 126 parallel to each other and align the flanges 68 opposite each other. A fastener such as a bolt 128 holds the glazing bars 114 and 116 together to retain the panels 32.

Figures 12A, 12B:
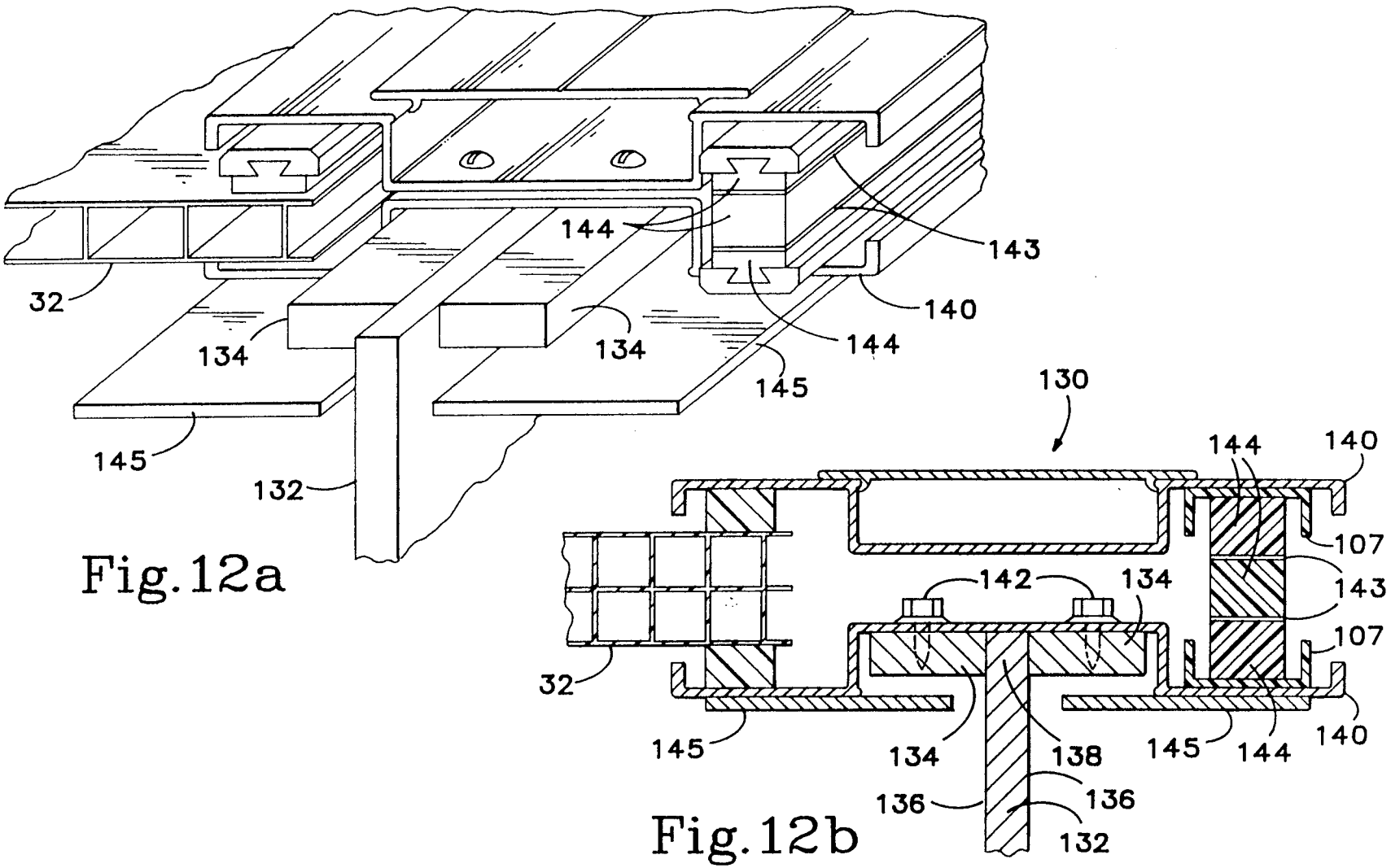
FIG. 12*a* is an oblique end view of an assembly according to the invention interconnecting panels perpendicularly as for a rake juncture of a roof panel and a wall panel.
FIG. 12*b* is a sectional end view of an assembly according to the invention interconnecting panels perpendicularly, as for a rake juncture of a roof panel and a wall panel.
Figure 13:
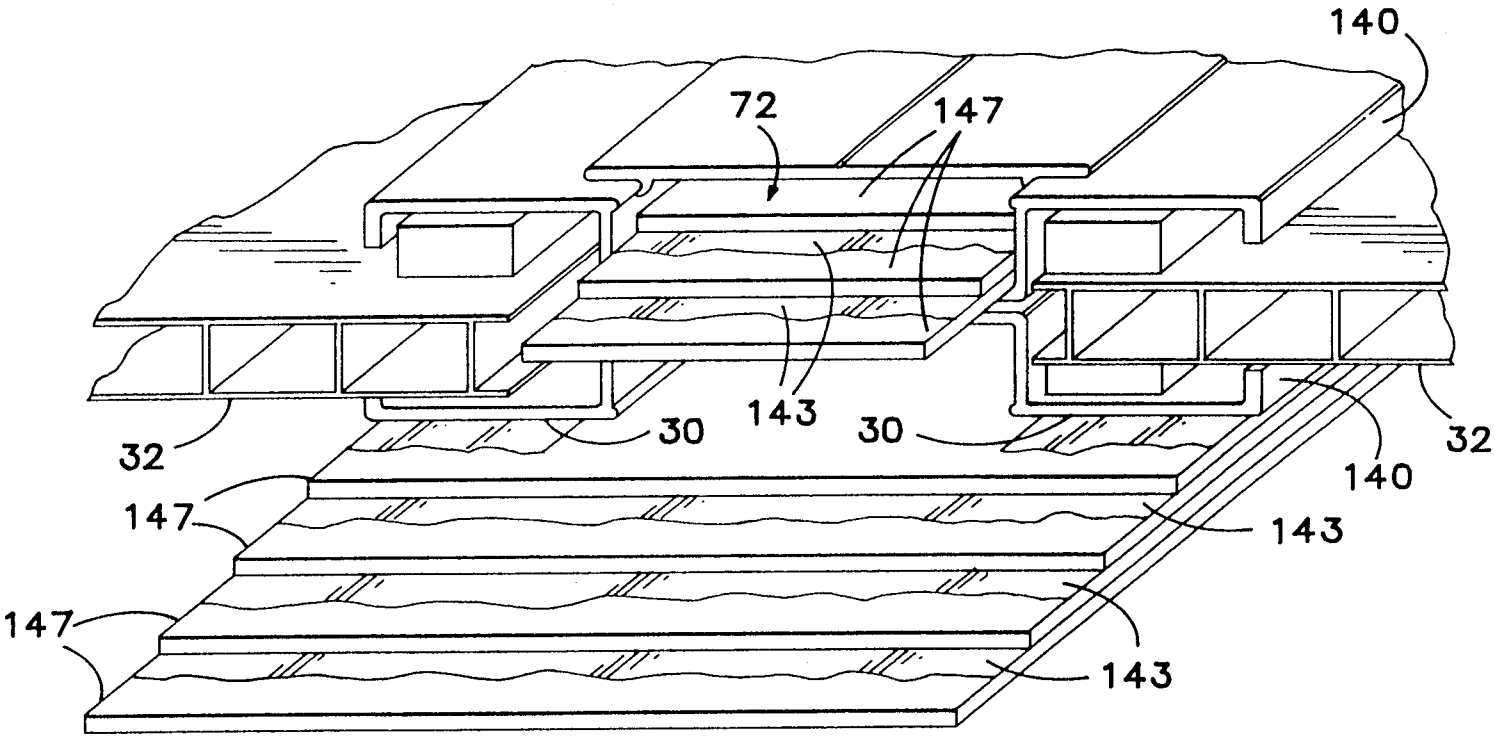
FIG. 13 is an oblique end view of an assembly according to the invention similar to that shown in FIG. 1 showing structural strapping that has been bonded together to create a solid member.

Referring now to FIGS. 12*a* and 12*b*, a panel connecting assembly 130 according to the invention is shown used as a rake for the connection of a roof panel 32 to a wall panel 132. A pair of rectangular solid members 134 are bonded to the respective main faces 136 along the margin of the wall panel 132. The wall panel 132 can be inserted into the receiver channel 138 of the glazing bar 140 and attached by fasteners such as screws 142, regardless of whether the glazing bar 140 be straight or curved. A further strengthening of the assembly 130 is achieved by bonding metal strapping 145 to the glazing bar 140 whether in a straight run or in a curve. This serves as a flange to assist in retaining the solid members 134 and panel 132. A filler member 144 is used in the channel of the assembly between one pair of wings of the pair of glazing bars 140, instead of a further extending panel margin. FIG. 12*b* shows a segmented filler 144. By using thinner segments, the unit can be shipped flat to the project site then field bonded with a very highly adhesive bonding tape 143 in a curved or flat shape. This avoids the need for preforming structural elements before shipping, avoids the shipping of an awkward shape, and allows custom assembly in the field to match the existing conditions. This is further illustrated in FIG. 13 where the thin strips 147 preferably are of suitably strong metal and are located either within the receiving chamber 72 of the glazing bar 140 or bonded to the exterior of the assembly 30. Again, this shows the structural member to be shipped flat and then field assembled in a laminated form with a flat or curved shape held by a suitable adhesive bonding tape 143. This avoids preforming of structural members, avoids shipping of awkward shapes, and allows custom assembly in the field to match the existing conditions.

Figure 14A:
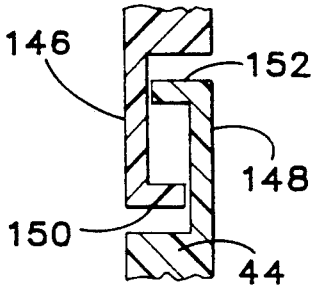
FIG. 14*a* is a view taken toward the main face of a panel showing one form of end joint for portions of a retainer strip.
Figure 14B:
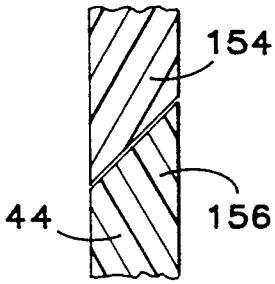
FIG. 14*b* is a view taken toward the main face of a panel showing,,another form of end joint for portions of a retainer strip.
Figure 14C:
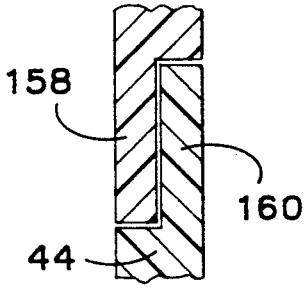
FIG. 14*c* is a view taken toward the main face of a panel showing yet another form of end joint for portions of a retainer strip.

FIGS. 14*a*, 14*b* and 14*c* show various ways in which adjacent ends of segments of retaining members 44 may be overlapped to allow, if necessary, for a difference between the thermal coefficients of expansion of the retainer members 44 and the material of a panel 32 to which such a retainer member is attached. Thus, in FIG. 14*a* opposite side portions 146 and 148 are overlapped longitudinally, and transverse portions 150 and 152 extend toward the overlapped portions 146 and 148. In FIG. 14*b* end portions 154 and 156 are diagonal and overlap. In FIG. 14*c* end portions 158 and 160 have a simple scarf joint.

Figure 15:
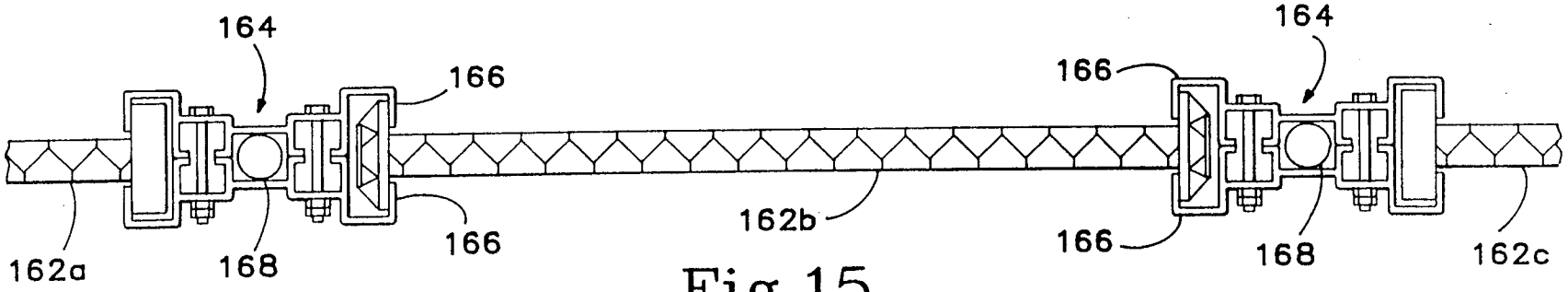
FIG. 15 is a sectional end view of a panel assembly including several panels interconnected to one another so as to be useful as a suspended skin portion of a structure.

Referring next to FIG. 15, three panels 162*a*, 162*b* and 162*c* are connected as panel assemblies 164 of glazing bars 166 with a cable 168 extending longitudinally through a cavity defined by each pair of glazing bars 166 to provide tensile strength for support of the panels and glazing bars. In a typical application of this embodiment of the invention, as shown at a larger scale in FIG. 16, the panels 162*a* and 162*b* will be held in tension with the retaining members 170 held tight against the flanges 172 of the glazing bars 166. The cable 168 or other structural material will be connected to a suitable supporting structure to carry the weight of the entire assembly of panels and glazing bars and to support loads imposed by weather conditions, as an enclosing "skin." The panel assembly 164 consists of two panels 162*a*, 162*b*, etc. which will usually, but not necessarily, be of plastic. A sandwich effect has been achieved by joining two glazing bars 166 by the use of fasteners such as bolts 174 which extend through faces 176 of the glazing bars located on a level above a gutter 178 intended to provide for drainage. In FIG. 17, an oblique sectional end view of one of the glazing bars 166 provides a better understanding of this "skin" assembly embodiment of the invention. Four flanges 180 fall in a common mating plane 182 between the middle pair of flanges. Flanges 180 are all located so that when mated they just keep the margins of the perpendicular flanges 184, corresponding to flanges 68 of the glazing bar 48, from coming into contact with the major faces 186 of the panels 162*a*, 162*b* when the surfaces 188 or 190 of the retaining members 192 and 194 are in contact with the respective interior surface 196 of the glazing bar assembly. An inner surface 198 of each flange 184 is desirably prepared to be flat and very smooth. This facilitates longitudinal movement of the panel margins within the channels defined by the flanges 184 as expansion and contraction of the panels occur.

A chamber 200 is provided between the two glazing bars to receive the cable 168.

Figure 18:
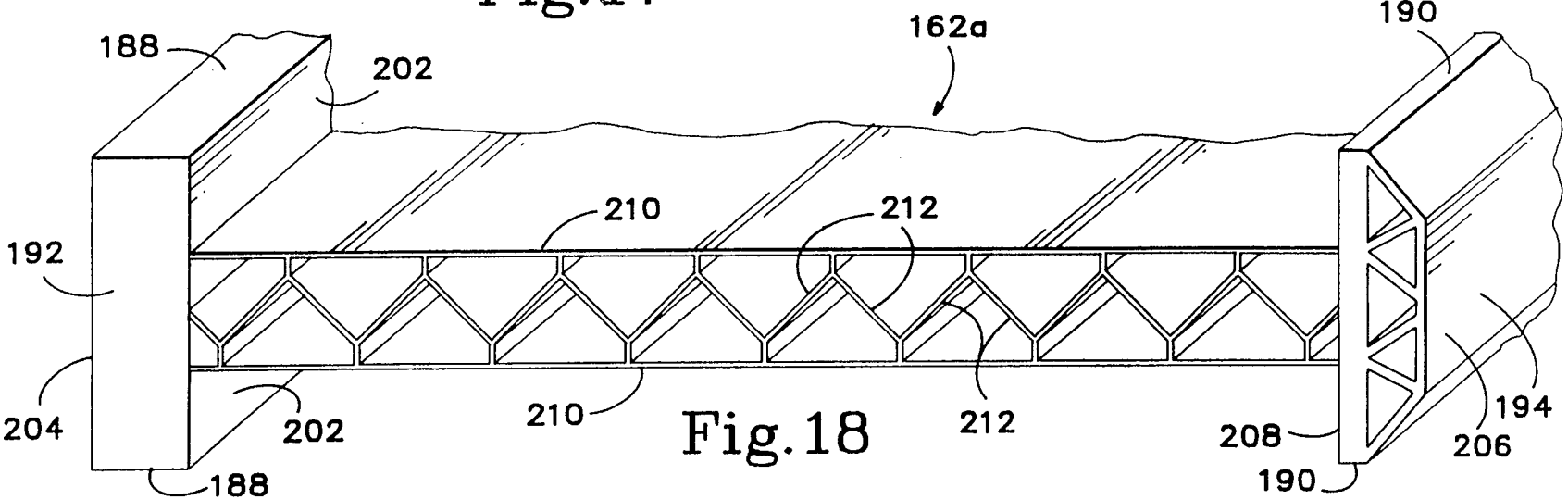
FIG. 18 is an oblique sectional end view of a panel for use with the glazing bar shown in FIG. 17, showing two different types of retainer members.

FIG. 18 is a sectional end view of an extruded plastic structural panel 162*a* for use in a tensioned skin panel assembly which is an embodiment of the invention. The panel 162*a* may be extruded with its retaining members 192, 194, corresponding functionally to the retaining members 44, in solid form as is retaining member 192, or in web form as is retaining member 194. Panels 162*a* may be extruded of one material or co-extruded of two or more plastics. The surfaces 188, 190, 202, 204, 206 and 208 should be of abrasion-resistant and preferably low-friction material to be able to slide freely along the interior surfaces 196 and 198 of the glazing bars 166. Such surface materials may be co-extruded, applied to the panel or the glazing bar. Major face sheets 210 are interconnected and spaced by a plurality of ribs 212 which divide the space between the two major face sheets 210 into a plurality of subspaces. All of these elements form a truss-like structure of which the two major face sheets 210 constitute the chords and the ribs 212 constitute the webs.

Figure 19:
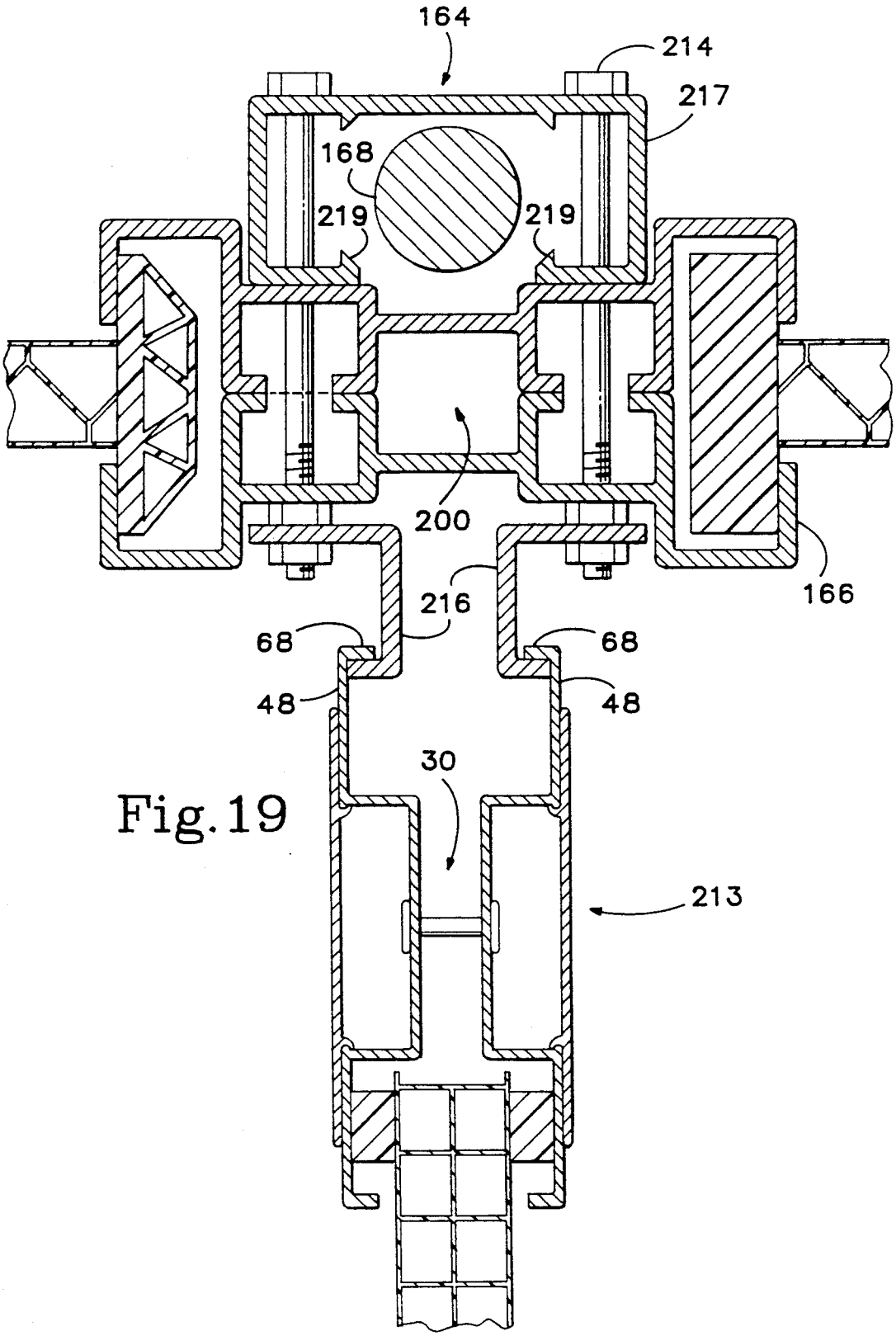
FIG. 19 is a sectional end view of an assembly similar to that shown in FIG. 15 acting as a roof, interconnected with a structural assembly according to the invention used as a wall.

FIG. 19 shows one manner of interconnecting a panel assembly 164 of the tension-bearing "skin" configuration as a roof portion to a panel assembly 30 as shown in FIG. 1, used as a wall section 213. By the use of removable fasteners such as bolts 214, longer than bolts 174 shown in FIG. 16, the wall section 213 can be permanently or removably attached to the roof portion. Hook-like extruded connectors 216 are bolted to the glazing bars 166 and engage flanges 68 of one pair of wing portions of the glazing bars 48 of the wall panel assembly 30. FIG. 19 also shows an optional bracket 217 to be used when a cable 168 needs to be larger than the internal chamber 200 will accommodate. Projections 219 keep the cable from coming in contact with the bolts 214.

Figure 16:
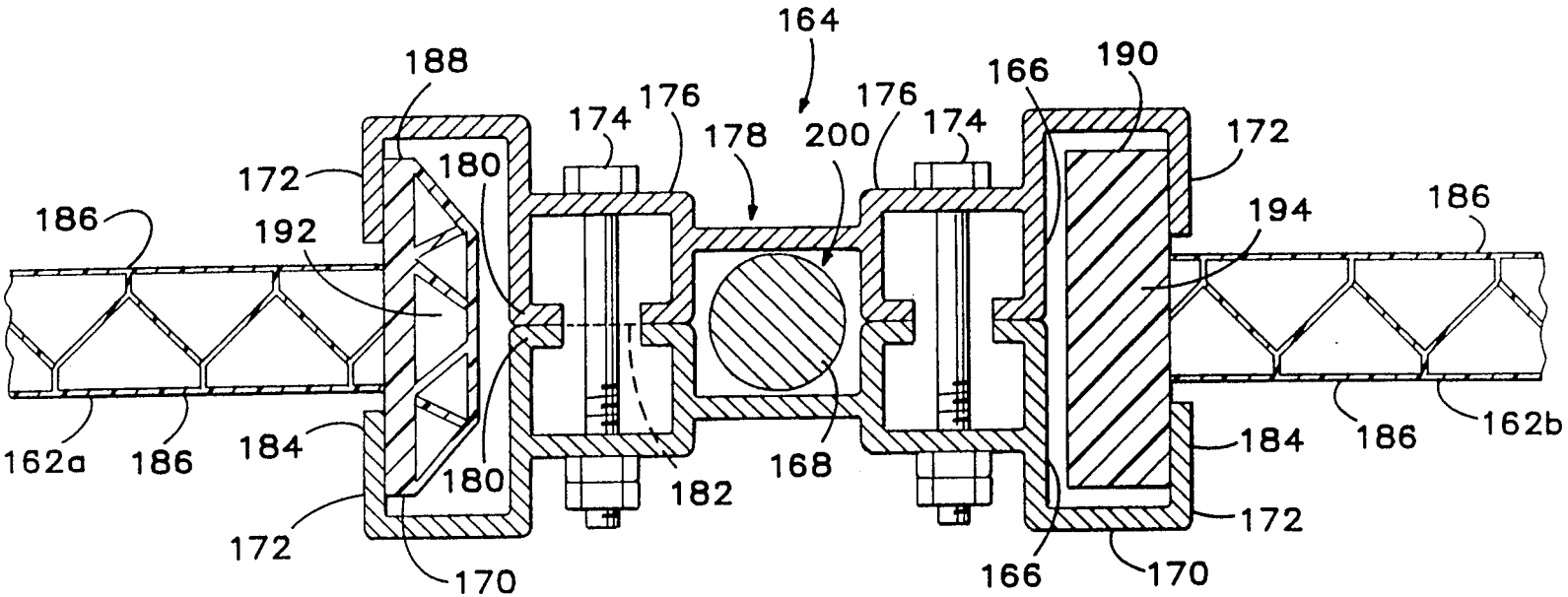
FIG. 16 is an end sectional view of a potion of an assembly of glazing bars and panels such as those shown in FIG. 15 at an enlarged scale.
Figure 17:
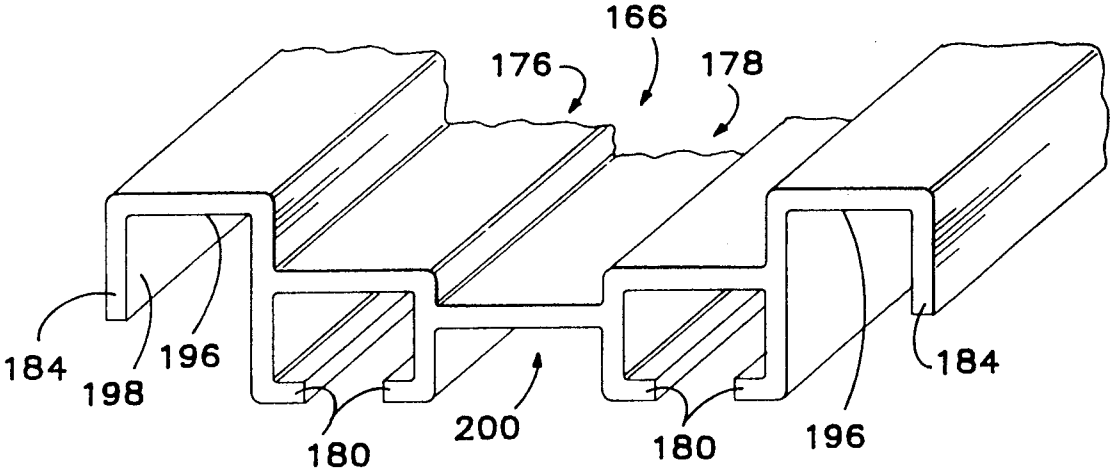
FIG. 17 is an oblique sectional end view of a glazing bar such as those shown in FIG. 16.
Figure 20:
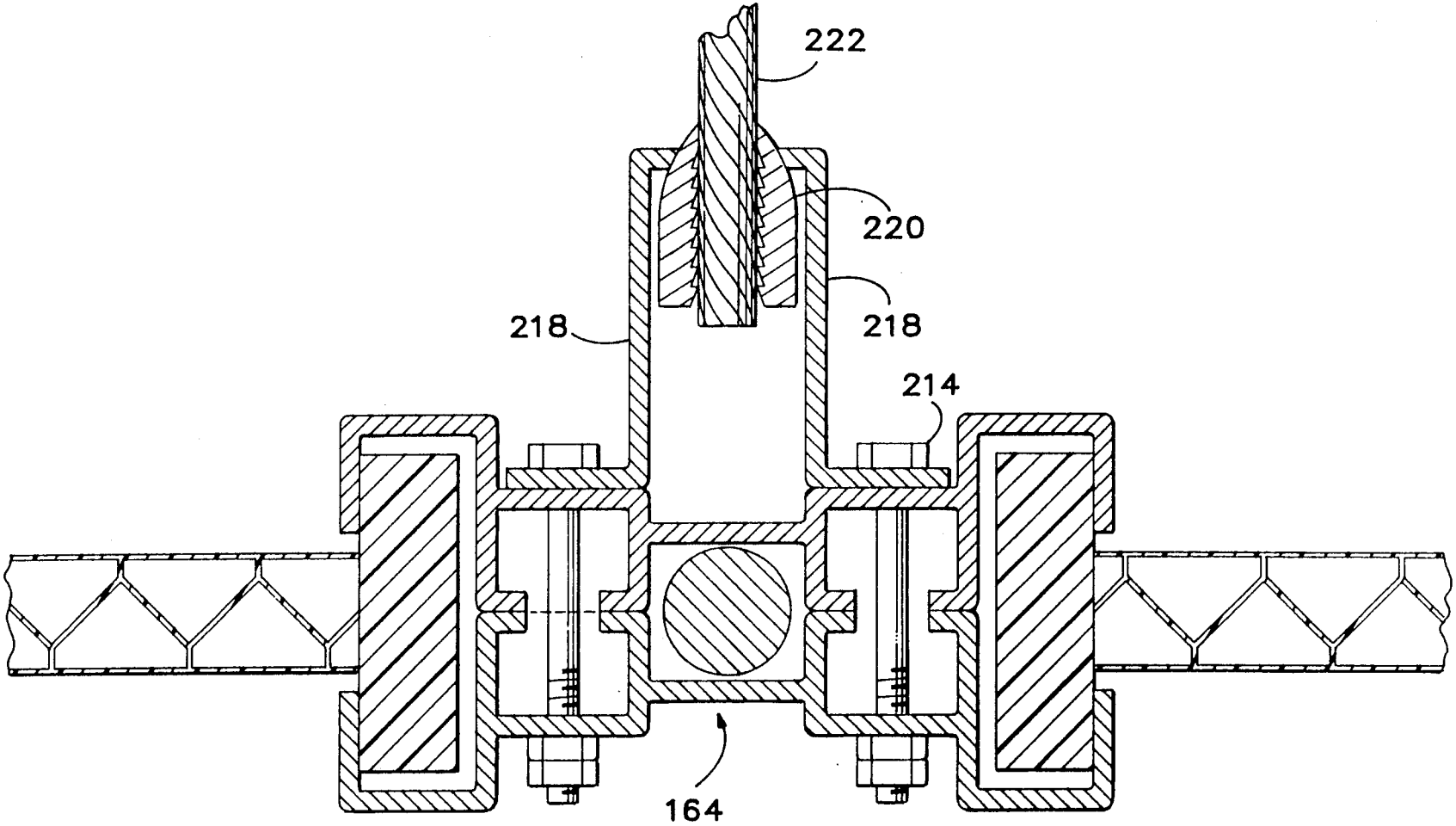
FIG. 20 is a view of a portion of a panel assembly similar to that shown in FIG. 16, showing a manner of attachment of a cable to support the panel assembly.

FIG. 20 shows the addition of a suspension cable connection to the panel assembly 164 shown in FIGS. 15 and 16. A bracket 218, which may comprise a pair of opposing extruded side portions, is attached at the proper position by fasteners such as bolts 214 extending through suitable holes in the bracket 218. A six-edged cable end fitting 220, or the equivalent, is used to retain the end of the cable 222 in the bracket 218.

Figure 21:
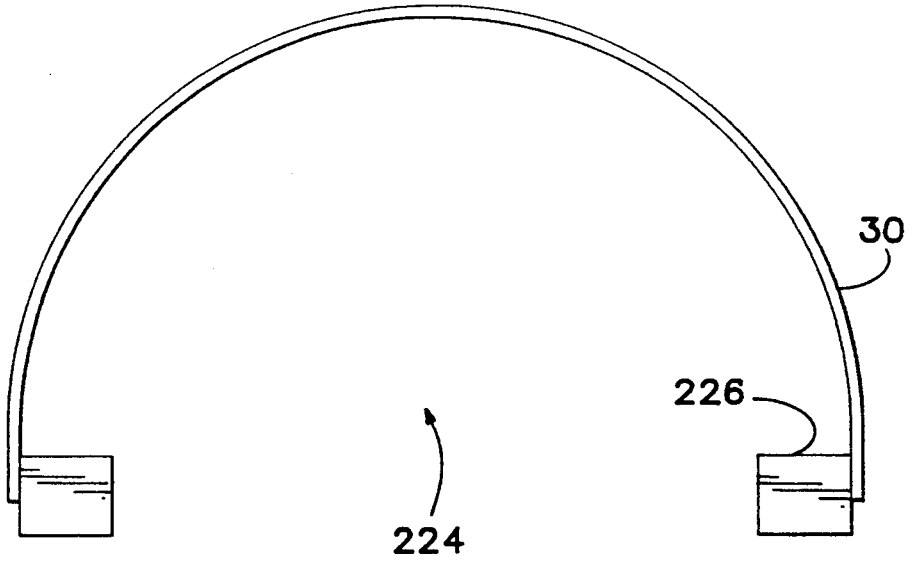
FIG. 21 is a simplified schematic view of a free-standing structure of panels assembled according to the present invention.

FIG. 21 shows a self-supporting panel structure 224 built in accordance with the invention with panels and glazing bars, such as the panel assemblies 30 of FIG. 1, in a free-standing mode, with the glazing bars bent about an axis transverse to the length of the glazing bars and panels, before the glazing bars of each pair are interconnected to retain the panels. The free-standing system is an assembly of several such parallel glazing bars and panels, and may include structural members in receiving channels 72 defined by the glazing bars of the panel assemblies. Respective ends of the glazing bars 48 are firmly attached to structural support forms 226.

Figure 22:
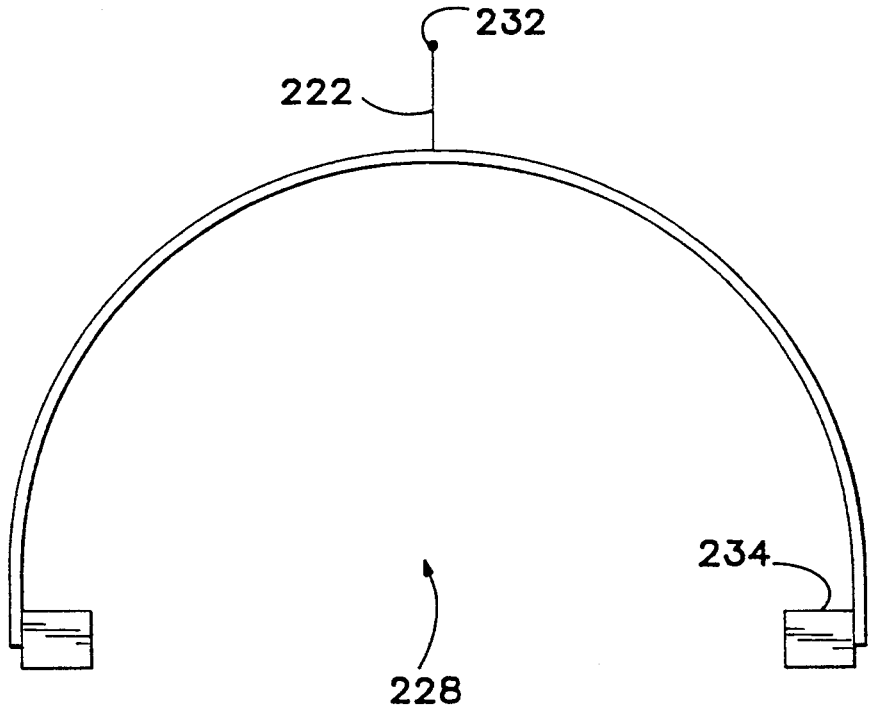
FIG. 22 is a simplified schematic end view of a convex structure of panels assembled according to the present invention and supported by a horizontal cable.

FIG. 22 shows a somewhat similar structure 228 in which panel assemblies embodying the invention of either the type shown in FIG. 1, or the type shown in FIGS. 15, 16, are partially supported by depending vertical suspension cables 222. Respective depending cables 222 supporting glazing bar and panel assemblies are supported by a main cable 232.

Figure 23:
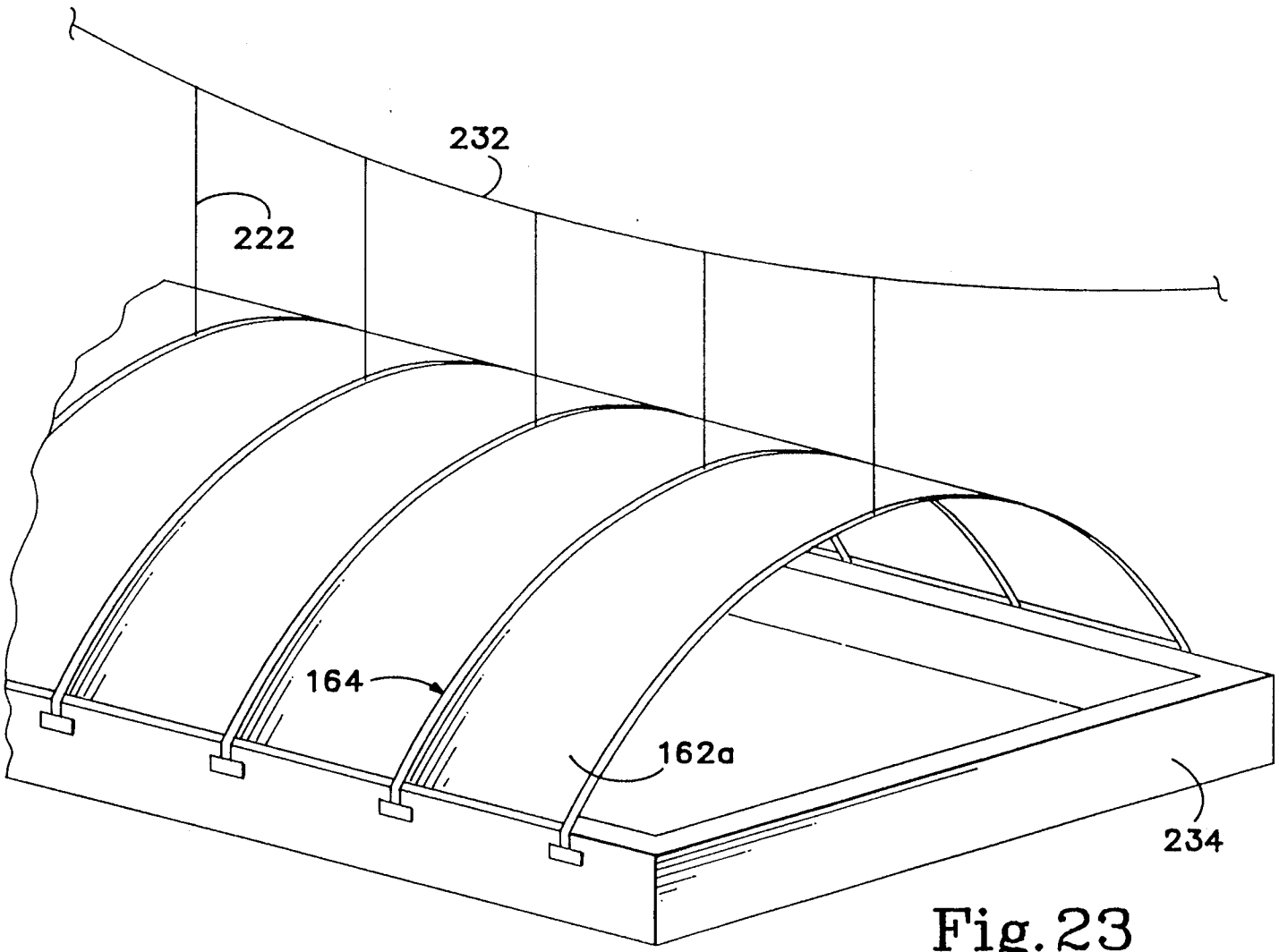
FIG. 23 is an isometric view of a portion of a structure generally similar to that shown in FIG. 22, including cable supported panels.

FIG. 23 shows panel assemblies 164 such as those of FIGS. 15 and 16 in use in the cable supported mode as a tension "skin". The system composed of panel assemblies 164 and panels 162*a*, optionally with or without structural members in respective chambers 200, is firmly attached to structural forms 234. The system is further supported by fastening a cable 222 (see FIG. 20) to the panel assemblies 164 and to a main cable 232.

Figure 24:
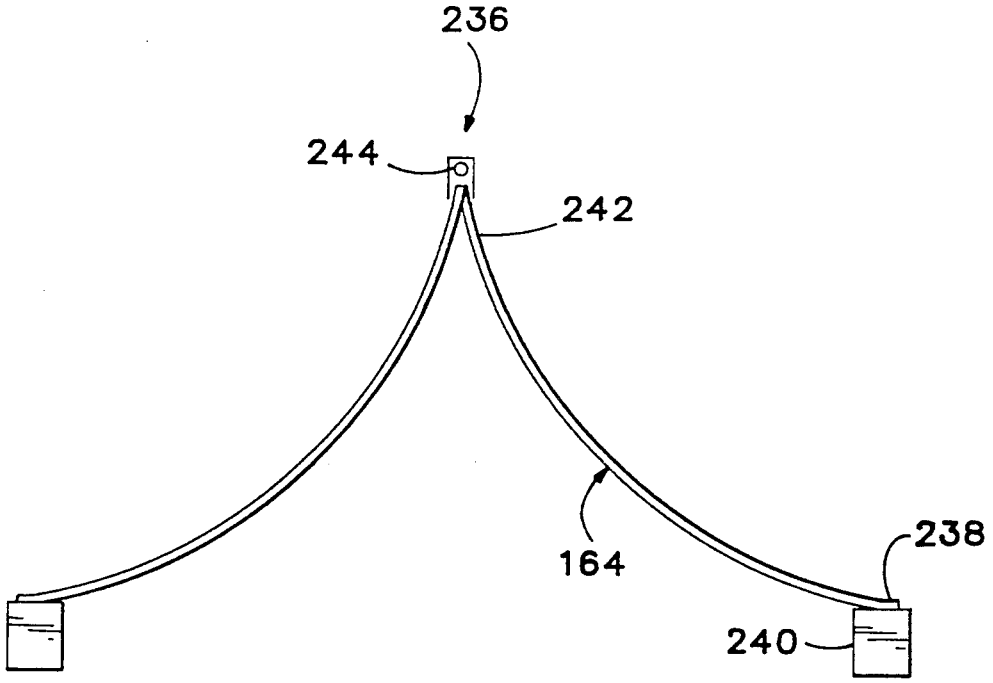
FIG. 24 is a simplified schematic end view of a concave-sided structure of panels assembled according to the present invention and supported by a longitudinal horizontal cable.
Figure 25:
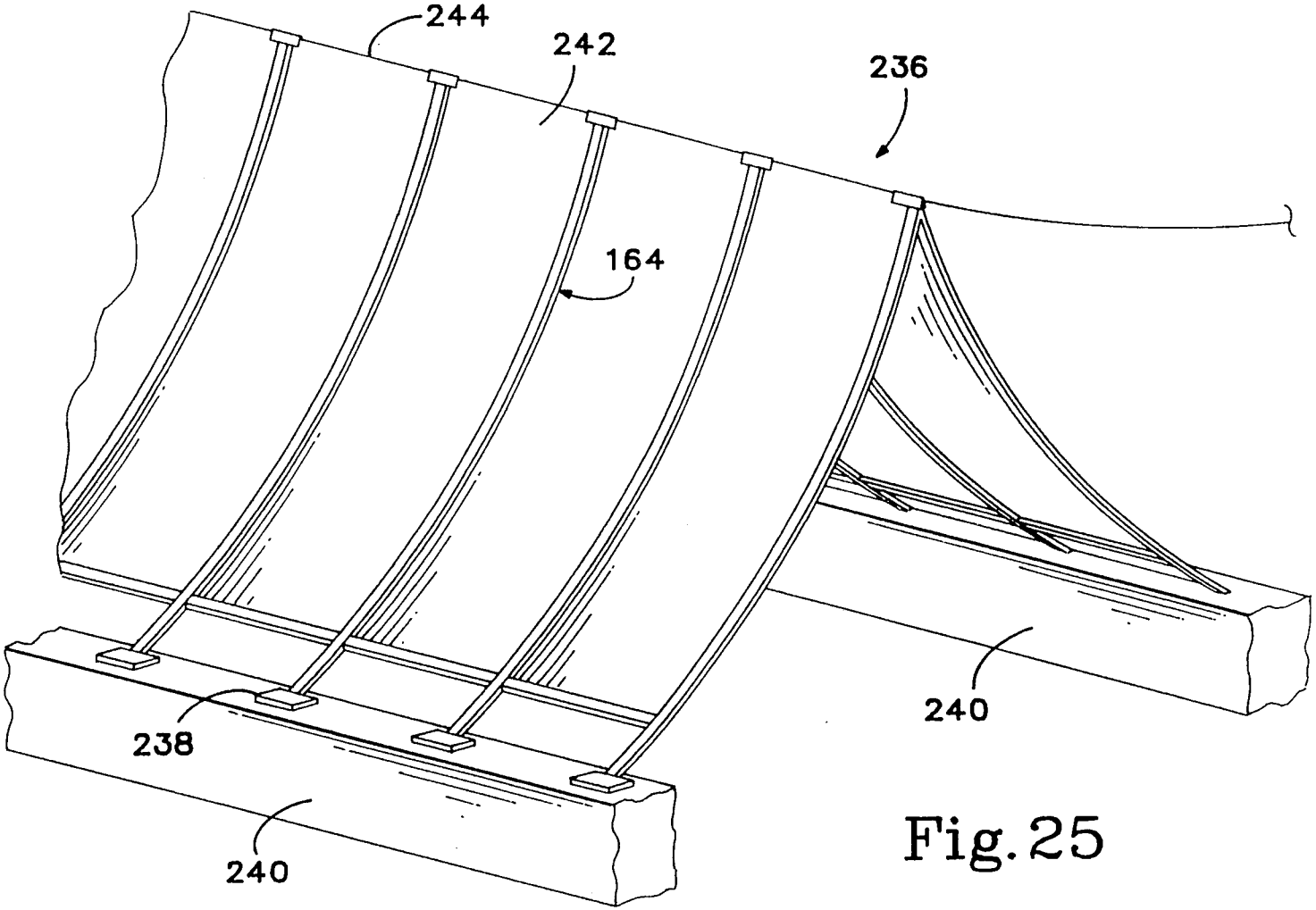
FIG. 25 is an isometric view of a portion of a structure including panels according to the invention in a "drape" configuration.

In FIGS. 24 and 25 system of tensional panel assemblies according to the invention is shown in simplified views in use as a cable supported, draped roof structure 236. The roof structure 236 comprises several panel assemblies 164 as shown in FIGS. 15 and 16, with or without structural members such as cables 168 in their chambers 200, as required by the size of the structure 236 and the area to be spanned. The lower end lower portions 238 of the structure 236 are firmly attached at the base to retaining structural forms 240. The upper ends 242 of the panel assemblies 164 are supported by fastening them to a generally horizontal main suspension cable 244 by a suitable clamp (not shown). This allows the panel assembly system of the roof structure 23 to act as a "skin" between the retaining base structure 240 and the main cable 244. The use of cables 168 in chambers 200 of the panel assemblies 164 allows the structure 236 to act as a structural system in tension between the retaining structure and the main cable 244.

Figure 26:
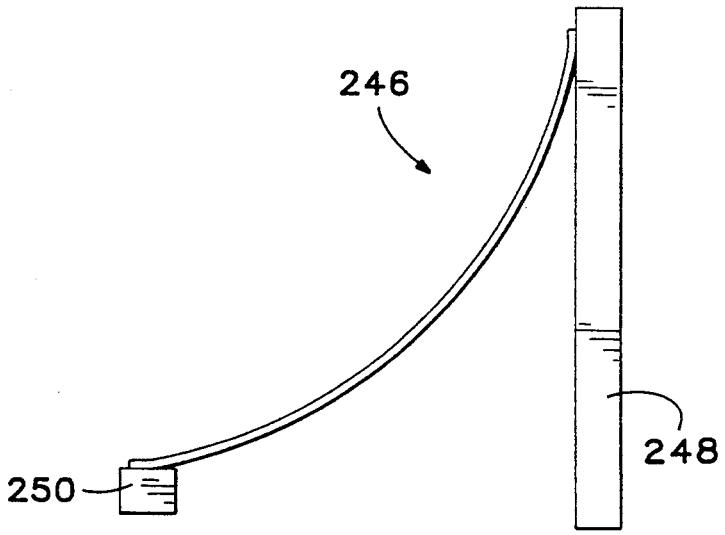
FIG. 26 is a simplified schematic end view of a structure including a concave drape wall of panels assembled according to the present invention.

In FIG. 26 a similar embodiment of the invention is shown as a roof structure 246 in the "drape" mode between a vertical wall 248 and attached at the base to structural forms 250. This allows the system to act as a "skin" between wall 248 and base structure 250.

Figure 27:
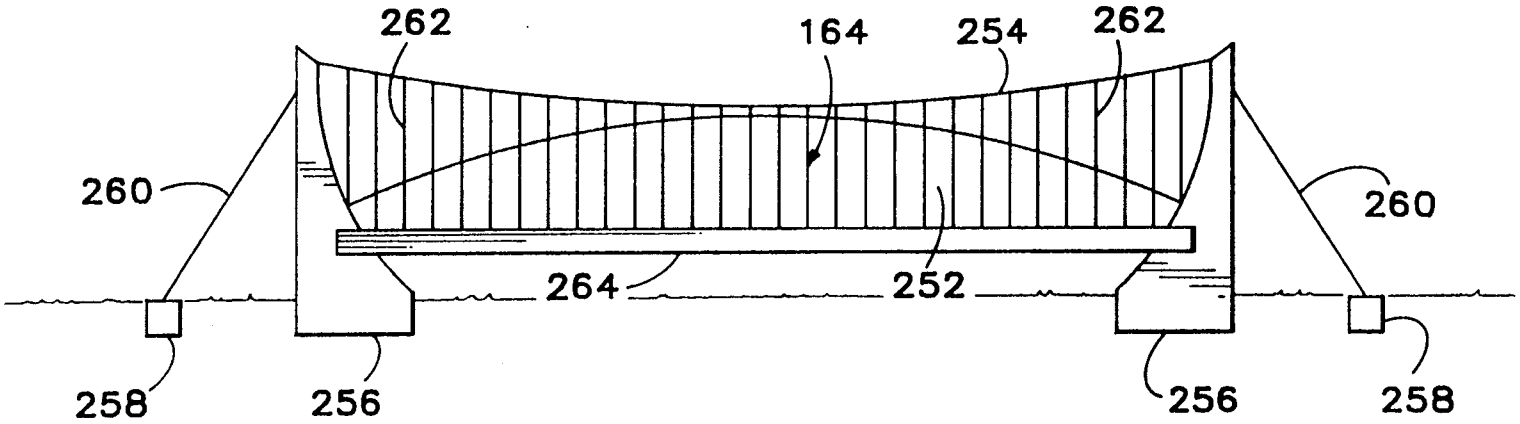
FIG. 27 a side elevation view of a cable-supported convex roof structure in accordance with the invention.
Figure 28:
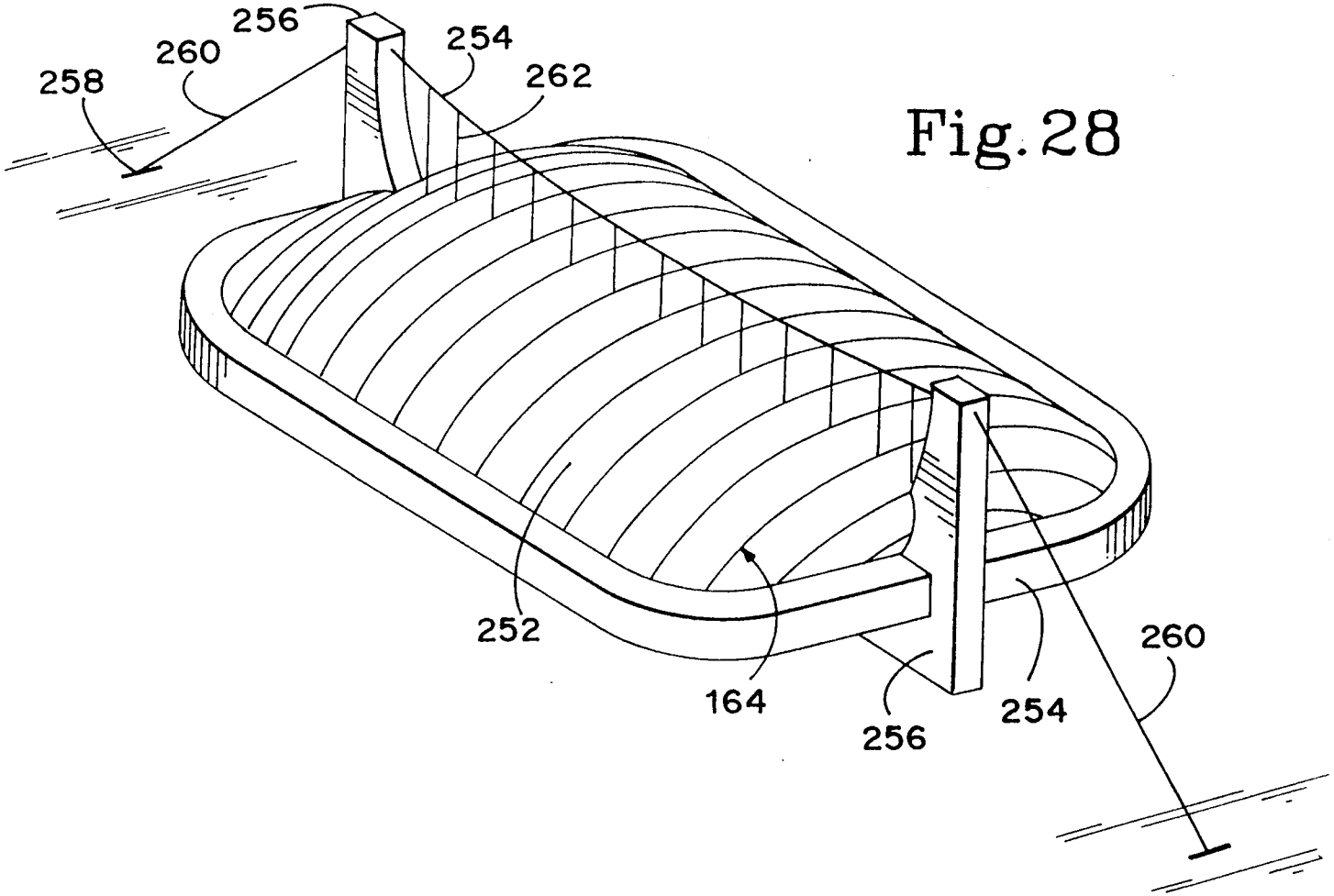
FIG. 28 is an isometric view of the cable-supported structure shown in FIG. 27.

As shown in FIGS. 27 and 28, the glazing bar and panel assemblies 164 of the present invention such as shown in FIGS. 15 and 16 may be assembled to form a skin 252 for a dome-like structure, stabilized and supported by a main cable 254 stretched between two supporting tower-like structures 256 and anchored as at 258 with cables 260. Properly spaced depending support cables 262 are fastened to the main cable, and to the glazing bar and panel assemblies 164 (see FIG. 20). The glazing bar and panel assemblies 164 (see FIGS. 15, 16), with or without cables 168 or other structural members in the chambers 200, are firmly attached at the base to a structural ring 264. The effect is to create a dome-like light-weight "skin" cover between the edges of the structural ring 264.

While the assemblies 30, 76, 164 and the like of glazing bars 48, 88, 166 and panels 32, 34, 162*a*, 162*b* and the like having retaining members 44, 46, 103, 111 and 170 and the like according to the invention are primarily meant to serve for light-transmitting wall or roof portions and are therefore designed to include plastic panels, the special properties of these assemblies such as their thermal (as well as acoustic) insulation effect, the ease with which larger panel surfaces are assembled, and their relatively low cost, suggest their use also for non-transparent walls, partitions, etc.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A structural assembly for incorporation into a building, comprising:

(a) a plastic panel having a pair of parallel opposite major faces and an elongate margin portion;

(b) panel support means for supporting said panel as a component of a building;

(c) at least one retaining member attached to one of said major faces of said panel along said elongate margin portion, said retaining member protruding outwardly away from and beyond one of said major faces of said panel and having an outer surface and a side surface;

(d) panel securing means included in said panel support means, for receiving said elongate margin and connecting said elongate margin to said panel support means while permitting said margin portion to move with respect to said panel securing means in a direction parallel with said major faces in response to flexure or thermal expansion or contraction of said panel differing from any flexure or thermal expansion or contraction of said panel support means, said panel securing means including opposed panel-support surfaces oriented parallel with said major faces, and a respective one of said panel support surfaces being located supportingly in contact with said outer surface of each said retaining member so as to support said panel through said retaining member; and (e) panel retaining surface means, included in said panel securing means and located facing toward and oriented generally parallel with said side surface of each said retaining member, for engaging said side surface and preventing removal of said elongate margin from said panel securing means in a direction transverse to said elongate margin portion and parallel with said major faces.

2. The assembly of claim 1 wherein said panel securing means includes a glazing bar having a flange extending toward said major face and including said panel retaining surface means.

3. The assembly of claim 1 wherein said flange extends toward said major surface a distance small enough to leave clearance between said flange and said major surface when said retaining member is in contact with a respective one of said panel-support surfaces.

4. The assembly of claim 1 wherein said side surface is oriented parallel with said elongate margin portion of said panel and substantially perpendicular to said major face of said panel.

5. The assembly of claim 1 including a pair of said retaining members located parallel to one another, one of said pair being located adjacent each of said opposite parallel major faces of said panel, said panel securing means including a respective one of said panel-support surfaces arranged to support each of said retaining members.

6. The assembly of claim 1 wherein said panel securing means includes a pair of glazing bars interconnected with each other and interconnecting a pair of said panels with their respective elongate margins substantially parallel with each other.

7. The assembly of claim 1 wherein said panel securing means includes a glazing bar including a middle portion defining a channel and two wing portions, one on each side of said middle portion.

8. The assembly of claim 1 wherein said panel securing means includes a pair of glazing bars, at least one of said glazing bars defining exterior channel means for receiving a structural member to support said assembly, and means for fastening said glazing bars together facing each other, each of said glazing bars including a respective one of said panel-support surfaces and a respective one of said panel retaining surface means, said panel-support surfaces and panel retaining surface means cooperatively defining a panel-holding channel having a width great enough to permit said margin portion to move within said channel, between a first position, in which said side surface of said retaining member is in contact with said panel retaining surface means, and a second position, in which said side surface of said retaining member is spaced apart from said panel retaining surface means.

9. The assembly of claim 1 wherein said panel securing means includes a pair of glazing bars and means for fastening said glazing bars together facing each other, each of said glazing bars including a respective one of said panel-support surfaces and a respective one of said panel retaining surface means, said panel-support surfaces and panel retaining surface means cooperatively defining a panel-holding channel, said pair of glazing bars cooperatively defining a cavity located between the ones of said pair of glazing bars and between the ones of said pair of margin portions, said panel-holding channel having a width great enough to permit said margin portion to move within said channel, between a first position, in which said side surface of said retaining member is in contact with said panel retaining surface means, and a second position, in which said side surface of said retaining member is spaced apart from said panel retaining surface means.

10. The structural assembly of claim 1 wherein said retaining member includes a plurality of inter-related elements, at least one of said elements being fixedly attached to one of said major faces of said panel along said elongate margin thereof.

11. The assembly of claim 1, including a plurality of said panels interconnected by said panel-securing means and held in tension as a "skin-like" surface stretched between supporting structures.

12. The assembly of claim 1 wherein said panel support means includes a pair of glazing bars and means for fastening said glazing bars together facing each other with said margin portion of said panel located between respective portions of said glazing bars that include said panel securing means, the assembly further including a plurality of thin layers of metal adhesively attached to one of said glazing bars and providing structural support thereto.

13. The assembly of claim 1 wherein said retaining member strip and said panel are an integral structure.

14. The assembly of claim 13 wherein said panel and said retaining member are formed integrally.

15. The assembly of claim 1 wherein said outer surface of said retaining member is oriented parallel with said major face and spaced outwardly away from said major face.

16. The assembly of claim 15 wherein said outer surface is of low-friction material in contact with a respective one of said panel-support surfaces of said panel securing means, to facilitate movement of said panel relative to said panel securing means in response to unequal expansion and contraction thereof.

17. The structural assembly of claim 1 wherein said retaining member includes a first element adhesively bonded to one of said major faces of said panel along said elongate margin thereof and a second element located in slidable contact with said first element and defining said side surface of said retaining member.

18. The structural assembly of claim 17 wherein said first element and said second element define mutually interlocking portions which attach said first and second element to each other.

19. The assembly of claim 1 wherein said retaining member is a strip of material attached by an adhesive to one of said parallel opposite major faces along said elongate margin portion of said panel.

20. The assembly of claim 19 wherein said retaining member is generally rectangular in section and is of a low-friction material.

21. The assembly of claim 1 wherein said panel support means includes a pair of glazing bars and means for fastening said glazing bars together facing each other, each of said glazing bars including a respective pair of said panel-support surfaces and a respective pair of said panel retaining surface means, said panel-support surfaces and panel retaining surface means cooperatively defining a pair of panel-holding channels each receiving said margin portion of a respective one of a pair of said panels arranged with said margin portions thereof substantially parallel, and each said panel-holding channel having a width great enough to permit said respective margin portion to move within said channel, between a first position, in which said side surface of said retaining member of said respective margin portion is in contact with a respective one of said panel retaining surface means, and a second position, in which said side surface of said retaining member is spaced apart therefrom.

22. The assembly of claim 10 wherein said panels are coplanar when held in said panel securing means.

23. The assembly of claim 21 wherein said glazing bars define said channels so as to receive said panels with said margin portions parallel but said panels in a non-parallel orientation with respect to each other.

24. A structure including a plurality of panels, comprising:

(a) a plurality of plastic panels each having a continuous sheet of material defining at least a respective one of a pair of parallel opposite major faces and defining a pair of generally parallel elongate margin portions;

(b) each panel having a retaining member attached thereto along each of said elongate margin portions, each said retaining member protruding outwardly from the respective panel beyond said respective continuous sheet of material defining one of said major faces thereof and each said retaining member having an outer surface and a side surface; and (c) panel securing means for receiving and holding one of said elongate margins of each of a pair of said panels, said panel securing means including respective opposed panel-support surfaces oriented parallel with said major faces and supporting a respective one of said panels by contact with said outer surface, and panel retaining surface means facing toward the respective side surface of each of said retaining members for engaging said respective side surface to prevent removal of said elongate margins from said panel securing means in a direction parallel with one of said major faces and transverse to said elongate margin portions, despite said panels being held in tension between respective ones of said panel securing means associated with the elongate margin portions of each of said panels.

25. A method of erecting a structure, including a panel of resiliently flexible material, comprising:

(a) providing a generally planar plastic panel having a pair of opposite major faces and an elongate margin portion;

(b) attaching a retaining member to said panel along said elongate margin thereof;

(c) attaching panel securing means t said elongate margin;

(d) holding said elongate margin in said panel securing means;

(e) supporting said panel and said panel securing means in a predetermined location and shape;

(f) shaping a sufficient plurality of overlapping, thin, flat structural support members to conform to said predetermined shape; and (g) attaching said support members to said panel securing means in laminated relationship to each other to provide a required amount of structural support to said panel and said panel securing means.

* * * * *

UNITED STATES PATENT AND TRADEMARK OFFICE

CERTIFICATE OF CORRECTION

PATENT NO. : 5,163,257

DATED : November 17, 1992

INVENTOR(S) : James Crowell

It is certified that error appears in the above-identified patent and that said Letters Patent is hereby corrected as shown below:

| | | |
|---|---|---|
| Col. 2, | Line 60 | After "structural" insert --member--; |
| | Line 63 | After "structural" insert --member--. |
| Col. 3, | Line 14 | Delete "shown in Fig. 9a"; |
| | Lines 23-24 | Delete "interconnect" and insert --interconnected-- in place thereof; |
| | Line 42 | After "showing" delete ",,"; |
| | Line 51 | Delete "potion" and insert --portion-- in place thereof. |
| Col. 4, | Line 42 | Delete "b" and insert --by-- in place thereof; |
| | Line 47 | Delete "to" (second occurrence). |
| Col. 6, | Line 32 | After "32" insert --is--. |
| Col. 9, | Line 37 | Delete "lower" (second occurrence); |
| | Line 44 | Delete "23" and insert --236-- in place thereof. |
| Col. 11, | Line 54 | Delete "structural". |
| Col. 12, | Line 5 | Delete "strip"; |
| | Line 18 | Delete "structural". |

UNITED STATES PATENT AND TRADEMARK OFFICE

CERTIFICATE OF CORRECTION

PATENT NO. : 5,163,257

DATED : November 17, 1992

INVENTOR(S) : James Crowell

It is certified that error appears in the above-identified patent and that said Letters Patent is hereby corrected as shown below:

Col. 14, Line 8 Delete "t" and insert --to-- in place thereof.

Signed and Sealed this

Fourteenth Day of December, 1993

Bruce Lehman

*Attest:*

BRUCE LEHMAN

*Attesting Officer*

*Commissioner of Patents and Trademarks*